United States Patent [19]

Hunziker

[11] 4,352,086

[45] Sep. 28, 1982

[54] METHOD AND A CIRCUIT ARRANGEMENT FOR MODIFYING CONTROL INFORMATION IN A TRAFFIC SIGNAL SYSTEM, PARTICULARLY A STREET TRAFFIC SIGNAL SYSTEM

[75] Inventor: Walter Hunziker, Buehler, Switzerland

[73] Assignee: Siemens Aktiengesellschaft, Berlin & Munich, Fed. Rep. of Germany

[21] Appl. No.: 145,710

[22] Filed: May 1, 1980

[30] Foreign Application Priority Data

Jun. 6, 1979 [DE] Fed. Rep. of Germany ..... 2922927

[51] Int. Cl.[3] ..... G08G 1/00; G08G 1/07

[52] U.S. Cl. ..... 340/35; 340/32; 340/37; 340/38 L; 340/41 R; 364/436

[58] Field of Search ..... 340/35, 36, 40, 32, 340/33, 34, 38 R, 38 L, 37, 41 R; 11/11; 364/436, 437, 438

[56] References Cited

U.S. PATENT DOCUMENTS

| | | | |
|---|---|---|---|
| 2,203,871 | 6/1940 | Koch | 340/32 |
| 3,249,915 | 5/1966 | Koerner | 340/38 |
| 3,257,641 | 6/1966 | Campana et al. | 340/32 |
| 3,638,179 | 1/1972 | Coll et al. | 340/32 |

FOREIGN PATENT DOCUMENTS

| | | | |
|---|---|---|---|
| 1481270 | 4/1966 | France | 340/38 |

*Primary Examiner*—John W. Caldwell, Sr.
*Assistant Examiner*—Donnie L. Crosland
*Attorney, Agent, or Firm*—Hill, Van Santen, Steadman, Chiara & Simpson

[57] ABSTRACT

A method and a circuit arrangement for modifying central control information commands forming signal programs in traffic signal systems in particular street traffic signal systems, the central control information commands being output from a central station to intersection devices of the system in order to control signal generators assigned to the intersection devices. This modification is to occur through the use of traffic information which are determined in the traffic areas whose traffic flows are to be controlled by the signal generators of the intersection devices. In order to be able to undertake a modification of the signal program sequencing in the respective intersection devices, modification time areas are determined in the form of partially overlapping central control information commands, in particular binary "1's" transmitted from the central station to the respective intersection device. Within these modification time areas, separate local control information commands can become effective for setting the signal generators.

9 Claims, 4 Drawing Figures

METHOD AND A CIRCUIT ARRANGEMENT FOR MODIFYING CONTROL INFORMATION IN A TRAFFIC SIGNAL SYSTEM, PARTICULARLY A STREET TRAFFIC SIGNAL SYSTEM

BACKGROUND OF THE INVENTION

1. Field of the Invention

The present invention relates to traffic signal systems, and is more particularly concerned with modifying control information forming frame signal programs, the control information being transmitted from a central station to intersection devices of the system, particularly of a street traffic signal system, for controlling signal generators belonging to the appertaining intersection devices, upon consultation of traffic information which may have been determined in the traffic areas whose traffic flow is controlled by the signal generators of the intersection devices.

2. Description of the Prior Art

A street traffic signal system is known from French Letters Pat. No. 1,481,270 which has a control central station and control devices connected thereto representing intersection devices, the control devices belonging to individual street intersections. The control devices are connected to traffic detectors with whose assistance the respective, current traffic situation is identified. The signals derived therefrom are then supplied to the central control station in order to change specific parameters of the signal schedules.

This, however, means that the individual control devices necessitate a correspondingly high circuit expense and that, moreover, justice cannot immediately be done to the respectively existing traffic conditions by means of an appropriate change of the signal schedules. On the contrary, under certain conditions, a relatively long time can be required in that the central control station is driven practically simultaneously by a multitude of control devices for a corresponding change of signal schedule.

SUMMARY OF THE INVENTION

The object of the present invention is to provide techniques by which frame signal programs transmitted in the form of control information from a central station to intersection devices of a traffic signal system, particularly a street traffic signal system, can be modified in a more flexible and rapid manner than is the case in street traffic signal systems heretofore known.

The above object is achieved, according to the present invention, by a method of the type generally mentioned above in that the control information for the determination of modification areas rendering possible a modification of the signal program sequencing in the respective intersection device are transmitted from the central station to the respective intersection device in the form of more or less overlapping control information commands individually relatable to each signal group.

By doing so, it is advantageously possible to assign a separate modification area to each independently controllable traffic flow.

In addition, the present invention offers the advantage that the signal program sequencing in the respective intersection device of the traffic signal system can be modified in a relatively simple manner and that the same can occur spontaneously since the safety times to be observed for safe regulation of traffic are formed by the intersection device itself. By evaluating the overlap areas of control information commands, in particular, it is possible in a particularly simple manner to modify modification areas of the signal program first offered by the central station only as a frame signal program for a signal group control in accord with existing, separate needs. If one transmits such control information commands overlapping only partially at intervals of one second from the central station to the respective intersection device, then justice can be done very easily and completely liberally therewith to the requirements for modification of the respectively cycling signal program, particularly given in street traffic systems, for example, due to changing traffic loads. Moreover, the modification of the signal programs can also be made to depend on other information, such as, for example, on the fact that a vehicle traveling along a traffic path requests a clear line along its path. If the travel path concerned is not yet provided for a clear line, then the appropriate request in this case will lead thereto, that it is precisely this particular clear line which is made possible. To this end, the appropriately cycling signal program will be modified. Finally, the ability of modifying the frame signal programs in the intersection devices is advantageously linked to the freedom of the control of these intersection devices from the central station, which is of particular use for higher order interventions in the signal schedules in order to achieve phased traffic flow controls.

Preferably, those of mutually hostile signal groups are exploited as the control information commands, i.e. the commands which, due to their partial overlap, determine modification areas which render possible a modification of the signal program sequencing in the respective intersection device. However, it is also possible to control the signal groups of traffic streams facing one another in such a manner that one traffic direction leads or lags with respect to the other.

For implementing the method of the present invention, it is advantageous to employ a circuit arrangement which is characterized in that an evaluation circuit is provided in each intersection device, the evaluation circuit accepting the control information emitted from the central station of the traffic signal system and evaluating such information for the control of the appertaining signal generator. A command recognition circuit is connected to the evaluation circuit and responds, given the occurrence of control information commands only partially overlapping and coming from the central station to emit an output control signal. A control circuit is connected to the command recognition circuit and responds to the output control signal to prevent the execution of the commands presently supplied from the central station to the appertaining intersection device and allowing the presently existing adjustment of tne appertaining signal generator to be modified according to the measure of setting commands separately supplied to the appertaining intersection device. By so doing, the advantage arises that one can make due with relatively less circuit expense in order to modify the signal program sequencing in the respective intersection device in the desired manner.

Advantageously, the setting commands separately supplied to the respective intersection device are derived from traffic information identified by a detector device connected to the respective intersection device. In this manner, a modification of the signal program cycling in the respective intersection device in accordance with the respective traffic conditions can be undertaken with a particularly low circuit expense.

Thereby, preferably with the assistance of a combinational logic circuit arrangement, setting commands are generated from the traffic information identified by the detector device such as do justice to the respective, momentary traffic load of the traffic paths to with the signal generators of the appertaining intersection devices are assigned. By so doing, different traffic conditions can be fixed as the criteria for whether and in which manner the signal program cycling in the respective intersection device is to be modified when a corresponding modification area exists.

Advantageously, an inhibiting circuit is connected to the combinational logic circuit arrangement to negate the evaluation of the control information supplied from the central station to the appertaining evaluation circuit only given the existence of specific, fixed setting commands or setting command combinations. By so doing, the advantage arises that those control information commands which have lead to the activation of the appertaining, fixed setting commands or setting command combinations, can themselves no longer influence the setting of the appertaining signal devices, so that, in this respect, a disruptive influence of the appertaining control information commands and the setting commands or setting command combinations is prevented.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
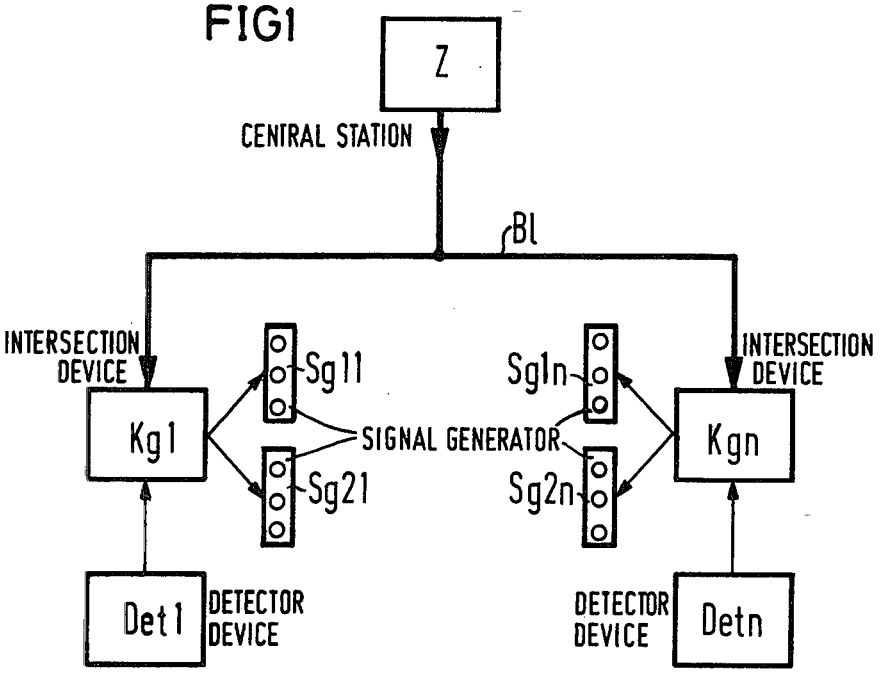
FIG. 1 is a block circuit diagram which schematically illustrates a traffic signal system operating in accordance with the method of the present invention.

The traffic signal system illustrated in FIG. 1, which may particularly be a street traffic signal system, comprises a central station Z which is connected by way of a bus B1 to a plurality of intersection devices Kg1–Kgn. The central station Z may contain a traffic control computer which emits different signal programs by way of the bus B1 to the individual intersection devices Kg1–Kgn as a function of various influencing magnitudes, such as, for example, the time of day. These signal programs, as will become more apparent below, represent frame signal programs, i.e. signal programs which can still be modified or, respectively, filled out.

The intersection devices Kg1–Kgn are a matter, so to speak, of decentralized control devices which, for example, are specifically allocated to individual intersections of traffic paths and which control signal generators permanently assigned to the traffic paths. According to FIG. 1, the intersection device Kg1 controls two signal generators Sg11 and Sg21. The intersection device Kgn illustrated in FIG. 1 controls two signal generators Sg1n and Sg2n.

A detector device is individually assigned to each of the intersection devices Kg1–Kgn. Therefore, a detector device Det1 is assigned to the intersection device Kg1 and a detector device Detn is assigned to the intersection device Kgn. These detector devices can determine the traffic loads at the intersections to which the intersection devices are assigned. However, it is also possible that the detector devices also identify other information and, subsequently, emit corresponding signals to their intersection devices. Therefore, for example, as was already suggested above, the detector devices can respond to the occurrence of specific signals which are emitted by specific vehicles in order to effect quite specific settings of the signal generators. Therefore, priority vehicles can emit request signals which are identified with the assistance of the appertaining detector devices and, in response to their identification, streets are given free for the priority vehicles concerned, insofar as these streets are not already given free. These priority vehicles, for example, can be public vehicles or service vehicles of police and fire departments.

With respect to the manner of operation of the traffic signal system schematically indicated in FIG. 1, the following should also be pointed out. The central station Z will supply signal programs adapted to the conditions of the individual intersections to the individual intersection devices Kg1–Kgn by way of the bus B1. To this end, the control information forming the appertaining signal programs are emitted, for example, on a time division multiplex basis, by way of the bus B1 to the individual intersection devices. So that the control information forming a signal program also arrive only at the respectively desired intersection device, the individual intersection devices can either be respectively effectively controlled by way of a separate addressing line extending from the central station Z or, on the other hand, the respective control information can be emitted provided with an address to which only one of the intersection devices responds in order to accept control information following the address. As will be explained below with reference to FIG. 2, these control information supplied to the individual intersection devices determine whether the signal program formed thereby is to be modified as a frame signal program.

Figure 2:
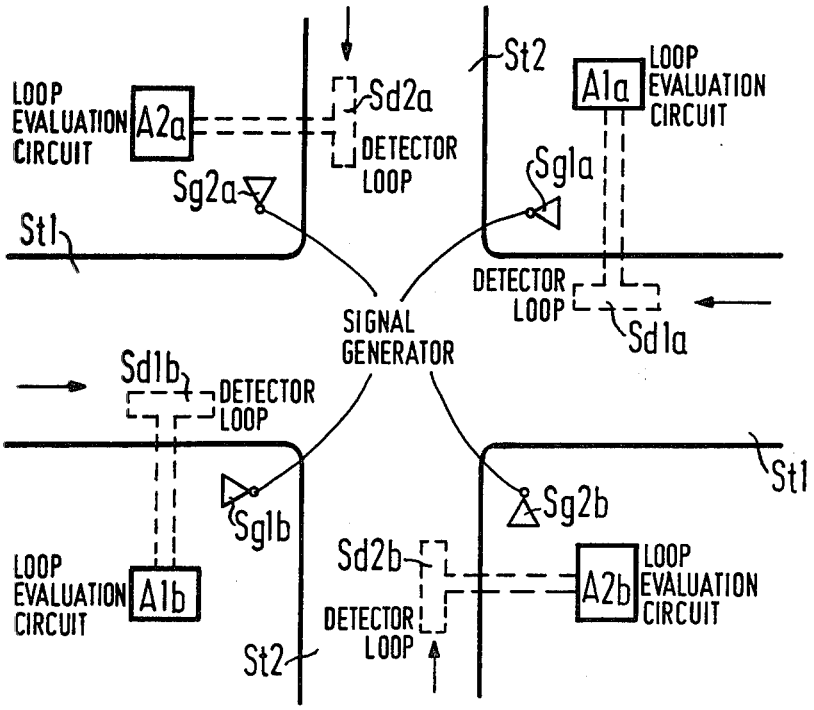
FIG. 2 is a schematic plan representation of a typical intersection having signal generators and detector devices.

FIG. 2 illustrates a typical intersection which comprises two streets St1 and St2 extending at right angles with respect to one another. A signal generator is located at each of the four intersection corners. The signal generators provided for signaling in respectively one of the two streets are respectively controlled in the same manner. These signal generators, on the one hand, are a matter of the two signal generators Sg1*a* and Sg1*b* and, on the other hand, it is a matter of the two signal generators Sg2*a* and Sg2*b*. The signal lights of the signal generators are therefore respectively controlled in a coincident manner and can be connected parallel to one another.

In accordance with FIG. 2, detector loops belonging to the streets St1 and St2 are provided in the area of the intersection. The detector loops Sd1*a* and Sd2*b* are assigned to the street St1 and the detector loops Sd2*a* and Sd2*b* are assigned to the street St2. These detector loops, which are indicated by means of broken lines, can be contained within the pavement of the respective street.

The detector loops are connected to loop evaluation circuits which are, in turn, connected to one of the intersection devices assigned to the appertaining intersection. The detector loop Sd1*a* is connected to a loop evaluation circuit A1*a*, and the detector loop Sd1*b* is connected to a loop evaluation circuit A2*b*. These two loop evaluation circuits A1*a* and A1*b* can be formed by a common loop evaluation circuit to which the two detector loops can be connected in parallel. In an analogous manner, the two detector loops Sd2*a* and Sd2*b* are connected to loop evaluation circuits A2*a* and A2*b*, respectively, which can likewise be formed by a common evaluation circuit to which the two latter detector loops can be connected in parallel.

Figure 3:
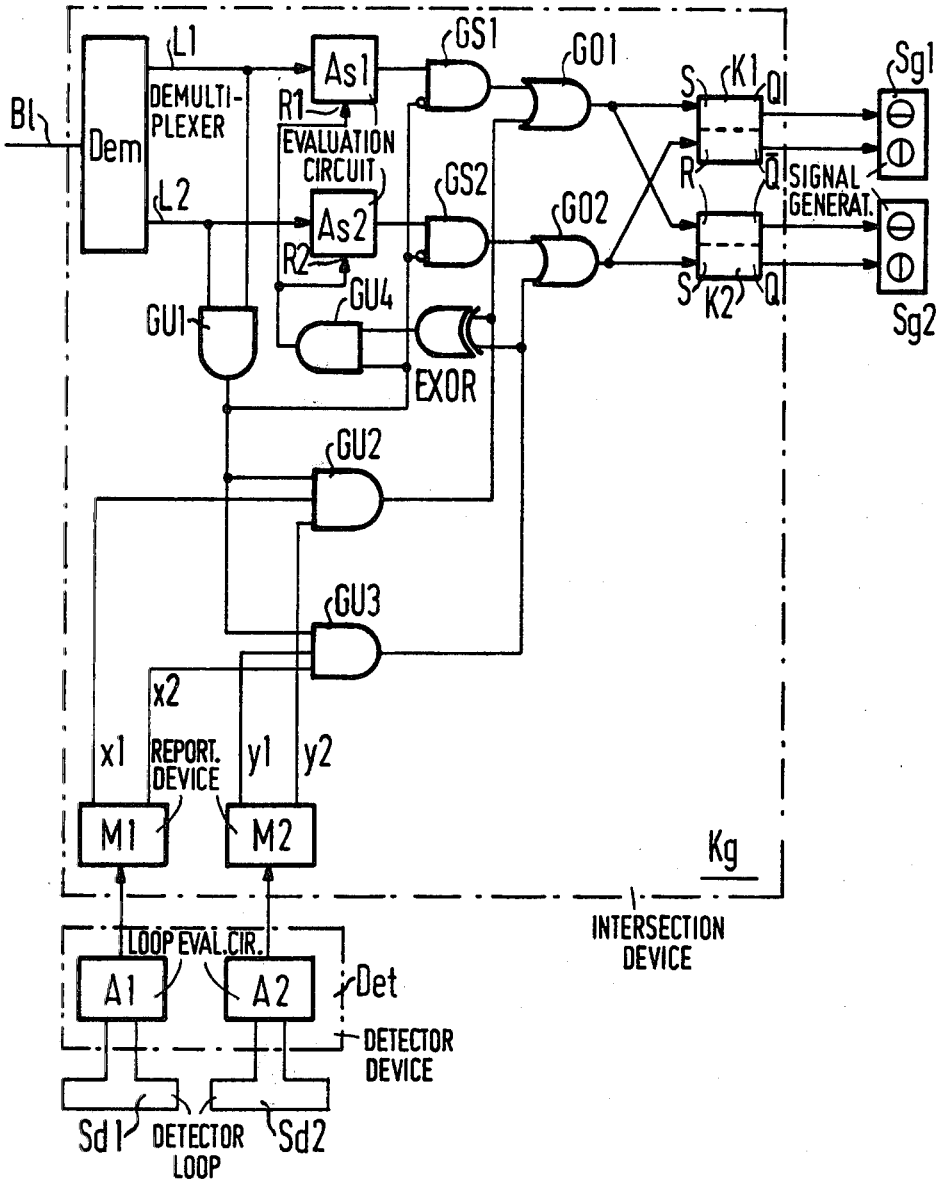
FIG. 3 is a schematic logic diagram illustrating a possible circuit design for one of a plurality of intersection devices having an appertaining detector device provided in the traffic signal system according to FIG. 1.

A possible design of one of the intersection devices indicated in FIG. 1 is illustrated in FIG. 3. The intersection device illustrated in FIG. 3 is referenced Kg. By way of two individual lines L1 and L2 the previously-mentioned, serially-emitted control information are supplied from a demultiplexer Dem connected to the bus B1 to the intersection device Kg as shown in FIG. 3. Two evaluation circuits As1 and As2 are connected to the lines L1 and L2, respectively, for receiving and evaluating these control information. These evaluation circuits As1 and As2 can respectively contain at least one bistable flip-flop which is set in accordance with the control information respectively supplied on the line L1 or on the line L2. An inhibiting element GS1 is connected with its signal input to the output of the evaluation circuit As1 and an inhibiting element GS2 is connected with its signal input to the output of the evaluation circuit As2. The blocking inputs of these inhibiting gates GS1 and GS2 are connected in common to the output of an AND gate GU1 which serves as a recognition circuit which will be discussed in greater detail below. The AND gate GU1 is connected with its two inputs to the lines L1 and L2.

An OR gate GO1 is connected with one input to the output of the inhibiting gate GS1, while another OR gate GO2 is connected with one of its inputs to the output of the inhibiting gate GS2. The other inputs of the two OR gates GO1 and GO2 are connected to outputs of a combinational logic circuit arrangement which, according to FIG. 3, is formed by two AND gates GU2 and GU3. The OR gate GO1 has its other input connected to the output of the AND gate GU2, while the OR gate GO2 has its other input connected to the output of the AND gate GU3.

Two bistable flip-flops K1 and K2 have their inputs connected to the outputs of the two OR gates GO1 and GO2. This is a cross-connection in which the bistable flip-flop K1 has its set input S connected to the output of the OR gate GO1 and its reset input R connected to the output of the OR gate GO2. Likewise, the bistable flip-flop K2 has its set input connected to the output of the OR gate GO2 and its reset input connected to the output of the OR gate GO1.

A signal generator Sg1, here a traffic light, is connected to the two outputs Q and $\overline{Q}$ of the bistable flip-flop K1. Another signal generator Sg2 is connected to the two outputs Q and $\overline{Q}$ of the bistable flip-flop K2. For the sake of simplicity, let it be assumed that upon the emission of a binary signal "1" from the output Q and, therefore, of a binary signal "0" from the output $\overline{Q}$ of the respective bistable flip-flops K1 and K2, the signal generator Sg1 or, respectively, Sg2, connected to the flip-flop illuminates its green signal light (horizontal line within a circle), whereas upon the occurrence of a binary signal "1" at the output $\overline{Q}$ and a binary signal "0" at the output Q of the respective bistable flip-flop its appertaining signal generator lights a red signal light (vertical line within a circle).

The two AND gate GU2 and GU3 belonging to the aforementioned combinational logic circuit arrangement are connected with their inputs in common to the output of the AND gate GU1. With two further inputs, the two AND gates GU2 and GU3 are respectively connected to the output side of two recognition or, respectively, reporting circuits M1 and M2 which are connected on their input sides to the outputs of a detector device Det. The detector device Det, for example, may contain two loop evaluation circuits A1 and A2, as were mentioned in conjunction with FIG. 2, to which detector loops are connected. In FIG. 3, for the sake of simplicity, only two detector loops Sd1 and Sd2 are illustrated. The signal supplied by the detector loop Sd1 and Sd2 and evaluated by the loop evaluation circuits A1 and A2, which may be oscillators with frequency determining circuits connected to the output thereof, are supplied to the reporting devices M1 and M2, which can be formed by threshold value loaded recognition circuits and which emit different signals as a function of the plurality of vehicles identified by the respective detector loop. It is indicated in FIG. 3 that each reporting device M1, M2 has two separate outputs. Binary signals "1" occur at the output x1 of the reporting device M1 and at the output y1 of the reporting device M2 in the case in which a green request exists for a specific traffic path—to which the respective reporting device M1 or, respectively, M2 belongs—i.e. a request to switch the green signal light on for this traffic path. If a binary signal "1" occurs at the output x1 of the reporting device M1 or, respectively, at the output y1 of the reporting device M2, then a binary signal "0" occurs at the output x2 of the reporting device M1 and, respectively, at the output y2 of the reporting device M2. In contrast thereto, a binary signal "1" occurs at the output x2 of the reporting device M1 or, respectively, at the output y2 of the reporting device M2 in the case in which the appertaining reporting device M1 or, respectively, M2, must emit an information according to which an "end of green" is possible for the traffic path to which the appertaining reporting device M1 or, respectively, M2 belongs.

The aforementioned AND gate GU2 is connected with two inputs to the output x1 of the reporting device M1 and to the output y2 of the reporting device M2. Likewise, the AND gate GU3 has one of its inputs connected to the output y1 of the reporting device M2 and another input connected to the output x2 of the reporting device M1.

In addition to the circuit elements considered above, the circuit arrangement illustrated in FIG. 3 also includes two further logic elements, namely an EXCLUSIVE OR gate EXOR and an AND gate GU4. The EXCLUSIVE OR gate EXOR is connected with its two inputs to the outputs of the two AND gates GU2 and GU3. The AND gate GU4 has one of its inputs connected to the output of the EXCLUSIVE OR gate EXOR and another input connected to the output of the AND gate GU1. The output of the AND gate GU4 which forms an inhibiting circuit together with the EXCLUSIVE OR gate EXOR, is connected to the blocking or, respectively, reset inputs R1 and R2 of the evaluation circuits As1 and As2. The bistable flip-flops assumed to belong to the evaluation circuits AS1 or, respectively AS2, can be connected with their reset inputs to these reset inputs R1 and R2 of the evaluation circuits As1 or, respectively As2.

Since the structure of the circuit arrangement illustrated in FIG. 3 has been explained above, its manner of operation will be considered in greater detail. To this end, let it first be assumed that the bistable flip-flop K1 is set and that the bistable flip-flop K2 is reset. Accordingly, the green light of the signal generator Sg1 is lit and the red signal light is lit in the signal generator Sg2. This signal condition is retained until a control information requesting a different signal condition is supplied by way of the lines L1 and L2 of the bus B1. If, on the one hand, one assumes that, for example, a binary signal "1" now occurs on the line L2 and that a binary signal "0" occurs on the line L1, these binary signals are received by the evaluation circuits As2 or, respectively, As1, and are relayed practically without change by way of the conductive inhibiting gates GS2 or, respectively, GS1 and the OR gates GO2 or, respectively, GO1 connected thereto. The binary signal "1" thus occurring at the output of the OR gate GO2 causes the setting of the bistable flip-flop K2 and the resetting of the bistable flip-flop K1. The consequence of this is that the red signal light of the signal generator Sg2 is extinguished and the green signal light of the signal generator Sg2 is illuminated. Conversely, in the signal generator Sg1, the green signal light is extinguished and the red signal light is illuminated. This signal condition also remains until altered control information is supplied by way of the lines L1 and L2. Since the AND gate GU1 in the example under consideration above emitted a binary signal "0" at its output, the AND gate GU2, GU3 and GU4 also respectively emitted a binary signal "0" at their outputs, the occurrence of the binary signals, however, not having triggered any further operations.

If one now assumes that two control informations in the form of only partially overlapping control information commands occur on the two lines L1 and L2, the commands being assumed to be formed by a binary signal "1" in the present case, then the following operations sequence. First, on the one hand, the AND gate GU1 operating as a command recognition circuit emits a binary signal "1" at its output upon whose occurrence the inhibiting gates GS1 and GS2 are blocked. The consequence of this measure is that signals for setting the bistable flip-flops K1 and K2 can no longer be emitted by the evaluation circuits As1 and As2. This blockage in the emission of corresponding signals from the evaluation circuits As1 and As2, however, may possibly be limited only to the temporal overlap area of the two control information commands occurring on the lines L1 and L2, as will become apparent in greater detail below.

The emission of a binary signal "1" from the output of the AND gate GU1 further leads to the fact that the two AND gates GU2 and GU3 are, so to speak, prepared for emitting binary signals "1". As should already be apparent from the above explanation of the detector device Det and the connection of the AND gates GU2 and GU3 to the reporting devices M1 and M2, the AND gate GU2 only emits a binary signal "1" at its output when a green request from the reporting device M1 exists and when the reporting device M2 signals the possibility of an end of green. A binary signal "1" is only emitted by the AND gate GU3 when the reporting device M2 signals a green request and when, at the same time, the possibility of an end of green is signaled by the reporting device M1. At this point it should be noted that the two reporting devices M1 and M2, in view of the explained linkage of the output signals emitted by the reporting devices M1 and M2 and the AND gates GU2 and GU3 are preferably allocated to intersecting traffic paths, to one of which the signal generator Sg1 belongs and to the other of which the signal generator Sg2 belongs.

When, in response to the supply of a binary signal "1" from the output of the AND gate GU1, a binary signal "1" is emitted by one of the two AND gates GU2 and GU3 and is transmitted by way of the OR gate GO1 or, respectively, the OR gate GO2 to the bistable flip-flops K1 and K2 which, in response thereto, are newly set under certain conditions. The occurrence of the binary signal "1" from the output of one of the AND gates GU2, GU3 further causes the EXCLUSIVE OR gate EXOR to emit a binary "1" at its output. Together with the binary signal "1" emitted from the output of the AND gate GU1, this output signal of the EXCLUSIVE OR gate EXOR causes a binary signal "1" to be emitted from the output of the AND gate GU4. This binary signal "1" blocks the evaluation of the control information just supplied to the evaluation circuits As1 and As2 in that the bistable flip-flops assumed to belong to these evaluation circuits As1 and As2 are reset. Therefore, after the disappearance of the control information commands from the lines L1 and L2, the evaluation circuits As1 and As2 can no longer exert a setting influence on the signal generators Sg1 and Sg2 according to the measure of the appertaining control information commands. In this case, the setting of the signal generators Sg1 and Sg2 only depends on the setting commands which have been supplied from or, respectively, triggered by the detector device Det.

In view of the manner of operation of the circuit arrangement illustrated in FIG. 3 just considered, it thus follows that, so to speak, a modification area of the frame signal program supplied to the appertaining intersection device proceeding from the central station is fixed by means of the control information commands occurring with an overlap on the lines L1 and L2 and that, within this modification area, the setting of the appertaining signal generators can be modified according to the measure of setting commands separately supplied to the appertaining intersection device.

In conjunction with the setting commands just mentioned, which are generated with the assistance of the combinational logic circuit arrangement of FIG. 3 and embracing the two AND gates GU2 and GU3, it can occur that these setting commands simultaneously occur in the form of binary signals "1". Given the circuit arrangement illustrated in FIG. 3, this means that the two AND gates GU2 and GU3 emit a respective binary signal "1" when a binary signal "1" is emitted from the output of the AND gate GU1. The occurrence of the binary signals "1" at the outputs of the AND gates GU2 and GU3 results in the fact that a respective binary signal "1" is supplied by way of the OR gates GO1 and GO2 to the set inputs S and to the reset inputs R of both bistable flip-flops K1 and K2. The simultaneous occurrence of binary signals "1" at both inputs of these bistable flip-flops K1 and K2 does not result in a setting or, respectively, resetting effect. Accordingly, the bistable flip-flops K1 and K2 remain in their previous conditions. In this case, the EXCLUSIVE OR gate EXOR emits a binary signal "0" at its output, so that a binary signal "0" is also emitted at the output of the AND gate GU4. The occurrence of this binary signal "0" results in the fact that the control information commands just occurring on the lines L1 and L2 are accepted into the evaluation circuits As1 and As2 and are retained therein. After the lapse of the overlap time interval between the appertaining control information commands, the commands contained in the appertaining evaluation circuits As1 and As2 can then be employed for setting the signal generators Sg1 and Sg2.

Operations corresponding entirely to the operations just considered also occur when the two AND gates GU2 and GU3 emit a respective binary signal "0" at their outputs during the time interval during which a binary signal "1" is emitted from the output of the AND gate GU1.

It has been explained above that the AND gate GU1 emits a binary signal "1" at its output when control information commands which only partially overlap occur on the two lines L1 and L2, the commands being respectively formed in the present case by a binary signal "1". Thereby, such control information commands come under consideration for the determination of the appertaining modifications areas belonging to mutually hostile signal groups. If, in this context, one assumes on the one hand that the green signal light is lit in the signal device Sg1 and the red signal light is lit in the signal device Sg2, then, for determining a modification area, a binary signal "1" is first supplied to the intersection device Kg by way of the line L1, the binary signal "1" again requesting illumination of the green signal light of the signal device Sg1, whereas a binary signal "1" also occurs on the line L2 only after a certain time delay, occurring, in particular in such a manner that an overlap range of the two control information commands (two binary "1's") now exists. Before occurrence of the trailing edge of the binary signal "1" supplied by way of the line L2, the trailing edge of the binary signal "1" previously supplied by way of the line L1 occurs. In order to be able to receive the control information commands thus presented on the two lines L1 and L2 into the evaluation circuits As1 and As2 in accordance with the respective momentary command state, these evaluation circuits will advantageously contain state-controlled bistable flip-flops. In this case, a command corresponding to a binary signal "0" will be retained in the evaluation circuit As1 and a command corresponding to a binary signal "1" will be retained in the evaluation circuit As2 between the time of the occurrence of the trailing edge of the binary signal "1" on the line L1 and the time of the occurrence of the trailing edge of the binary signal "1" on the line L2.

As already explained above, the acceptance or, respectively, evaluation of control information commands supplied by way of the lines L1 and L2 is to be prevented in the case in which only one of the AND gates GU2 and GU3 emits a binary signal "1" at its output. To this end, as likewise already explained above, a corresponding blocking signal (binary signal "1") is emitted from the output of the AND gate GU4. The effectiveness of this blocking signal in the evaluation circuits As1 and As2 will make a certain duration of this signal necessary in the case in which the two control information commands on the lines L1 and L2 only overlap during a short time interval. In order to be able to achieve the desired effect in this case as well, a monostable flip-flop, for example, can be connected to the output of the AND gate GU4, the monostable flip-flop, in response to the output of a binary signal "1" by the AND gate GU4, emitting a binary signal "1" at its output during an interval within which the two control information commands on the lines L1 and L2 have disappeared.

Let it also be particularly pointed out that it has been assumed in the discussion above of the circuit arrangement illustrated in FIG. 3 that the evaluation circuits As1 and As2 are individually assigned to the lines L1 and L2. In fact, however, these evaluation circuits only represent partial evaluation circuits of an overall evaluation circuit. In respect to the transmission of control information commands over the lines L1 and L2 let it also be pointed out that this transmission can occur on a specific time basis, for example, in a one second sequence, and that the control information commands respectively occurring on the lines L1 and L2 can always overlap upon determination of a modification area. By so doing, it is then possible to modify the frame signal program supplied from the central station to the respective intersection device second-by-second according to the measure of separate setting commands. These setting commands, thereby, need not be such setting commands as were specifically explained with reference to FIG. 3. On the contrary, these setting commands can also be a matter of request commands on the part of specific traffic participants who, for example, request the switching-on of the green signal lights which exists on their traffic paths.

In summary, it should also be noted that separate safety devices can also be contained in the intersection devices which prevent the switching-on of the signal generators at inopportune times, i.e. at times that are not desired. Such safety devices can be connected to the outputs of the bistable flips K1 and K2 in the circuit arrangement of FIG. 3. Moreover, let it also be pointed out that a microprocessor or, respectively, a microcomputer can be employed for realizing the circuit arrangement illustrated in FIG. 3.

Figure 4:
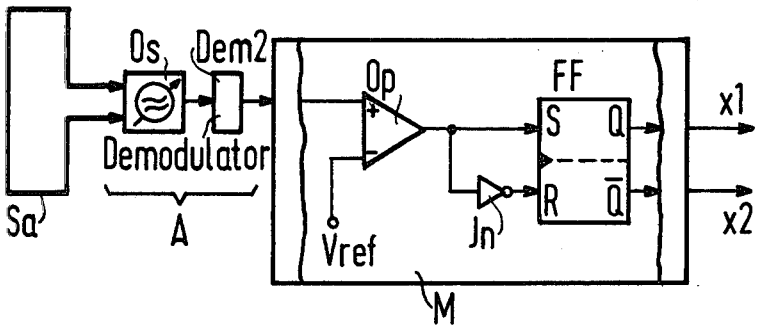
FIG. 4 is a schematic circuit diagram of a possible realization of a reporting device with the appertaining loop evaluation circuit belonging to the intersection device according to FIG. 3.

The reporting devices M1 and M2 belonging to the intersection device of FIG. 3 can be respectively realized in the manner shown in FIG. 4. The reporting device M schematically indicated in FIG. 4 includes an operational amplifier Op on its input side which serves as a comparator or, respectively, as a threshold value loaded evaluation circuit, the operational amplifier receiving output signals from the loop evaluation circuit A assigned thereto at its non-inverting input (+). A reference voltage Vref is applied to the inverting input (−) of the operational amplifier Op. The output of the operational amplifier Op is directly connected to the set input S of a flip-flop FF and is connected to the reset input R of the flip-flop FF by way of an inverter In. The two outputs Q and $\overline{Q}$ of the flip-flop FF are connected to the outputs (referenced in FIG. 4 with x1 or, respectively, x2 as in FIG. 3) of the reporting device M.

With respect to the loop evaluation circuit A shown in FIG. 4, it should also be pointed out that this, in principle, can contain an oscillator Os, in particular a voltage controlled oscillator (VCO) with a demodulator Dem2 connected to its output as is known, for example, from FIG. 9 of U.S. Pat. No. 3,249,915. The frequency of the oscillator OS is determined in a known manner by the inductance of the appertaining detector loop Sa.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A circuit arrangement for controlling and modifying central control information commands in a traffic signal system comprising:

a central control station for transmitting central control information commands and at least one intersection device for receiving the central control information commands, and signal generators connected to said intersection device;

an evaluation circuit in said intersection device for evaluating the central control information commands and emitting command signals for controlling the signal generators in response thereto;

a command recognition circuit connected to receive the same central control information commands as said evaluation circuit and responsive to overlapping control information commands to produce an output signal;

local control information commands input means for receiving local control information commands concerning the traffic conditions at the intersection; and a control circuit connected between said evaluation circuit and said signal generators and connected to said command recognition circuit and to said local control information commands input means and responsive to the output signal from said command recognition circuit to block operation of said signal generators in response to the overlapping control information commands transmitted by said central station and to permit operation of said signal generators in accordance with the local control information commands supplied to said intersection device, including means for operating said signal generators in accordance with said local control information commands.

2. The circuit arrangement of claim 1, wherein said local control information commands input means comprises: traffic detector means connected to said control circuit for providing traffic flow information thereto.

3. The circuit arrangement of claim 2, and further comprising:

logic means in said local control information commands input means connected to said command recognition circuit and to said traffic detector means and to said control circuit for logically linking output signals from said command recognition circuit and local control information commands.

4. The circuit arrangement of claim 3, and further comprising:

inhibiting means connected between said command recognition circuit and said local control information commands input means, and said evaluation circuit, for disabling operation of said evaluation circuit in response to specific control information or combinations of control information.

5. The circuit arrangement of claim 4, wherein said inhibiting means comprises:

an EXCLUSIVE OR gate having inputs connected to said local control information commands input means and an output; and an AND gate including inputs connected to said EXCLUSIVE OR gate and said command recognition circuit, and an output connected to said evaluation circuit.

6. The circuit arrangement of claim 1, wherein said evaluation circuit comprises:

a pair of bistable circuits for receiving respective control information commands.

7. The circuit arrangement of claim 1, wherein:

said traffic signal system operates on a time division multiplex basis and includes a plurality of said circuit arrangements each comprising an input demultiplexer including first and second ouputs connected to said evaluation circuit.

8. The circuit arrangement of claim 7, wherein:

said command recognition circuit comprises an AND gate having inputs connected to respective first and second outputs of said demultiplexer.

9. In a method of modifying central control information commands forming signal programs, which includes the steps of transmitting the central control information commands from a central station to an intersection device of a traffic signal system which controls traffic signal generators connected thereto, and by transmitting local control information commands obtained from traffic information from an area whose traffic flow is controlled by the signal generators, the improvement comprising the steps of:

transmitting control information commands from the central station to the intersection device with periods of overlapping control information commands, said periods defining permission time for controlling said signal generators only by said local control information commands; and detecting such periods of overlapping control information commands; and transferring operational control of said traffic signal generators from said control information commands transmitted from said central station to said local control information commands.

* * * * *